US007716855B2

(12) United States Patent
Gallay et al.

(10) Patent No.: US 7,716,855 B2
(45) Date of Patent: May 18, 2010

(54) MOUNTING FOR RETAINING A BOOT ON A SNOWSHOE

(75) Inventors: Philippe Gallay, La Clusaz (FR); Bruno Deloustal, Annecy (FR)

(73) Assignee: TSL Sport Equipment, Alex (FR)

( * ) Notice: Subject to any disclaimer, the term of this patent is extended or adjusted under 35 U.S.C. 154(b) by 542 days.

(21) Appl. No.: 11/657,348

(22) Filed: Jan. 24, 2007

(65) Prior Publication Data

US 2007/0289169 A1 Dec. 20, 2007

(30) Foreign Application Priority Data

Jan. 25, 2006 (FR) ..... 06 00891

(51) Int. Cl.
*A43B 5/00* (2006.01)

(52) U.S. Cl. ..... 36/122; 36/124; 36/125

(58) Field of Classification Search ..... 36/122–125
See application file for complete search history.

(56) References Cited

U.S. PATENT DOCUMENTS

| | | | | |
|---|---|---|---|---|
| 4,836,571 A | | 6/1989 | Corbisiero | 280/600 |
| 5,341,582 A | * | 8/1994 | Liautaud | 36/7.6 |
| 5,829,173 A | * | 11/1998 | Svetlik et al. | 36/124 |
| 5,901,471 A | * | 5/1999 | Warner | 36/124 |
| 6,367,173 B2 | * | 4/2002 | Lancon | 36/122 |
| 6,527,293 B1 | | 3/2003 | Roy et al. | 280/624 |
| 7,308,767 B2 | * | 12/2007 | Soriano et al. | 36/125 |

FOREIGN PATENT DOCUMENTS

| | | |
|---|---|---|
| EP | 0 671 190 | 9/1995 |
| EP | 0 707 874 | 4/1996 |
| FR | 2 606 660 | 5/1988 |
| FR | 2 742 347 | 6/1997 |
| FR | 2744642 | 8/1997 |
| FR | 2 760 375 | 11/1998 |
| WO | WO 00/62636 | 10/2000 |

* cited by examiner

*Primary Examiner*—Marie Patterson
(74) *Attorney, Agent, or Firm*—Fay Sharpe LLP

(57) ABSTRACT

A snowshoe (1) includes a binding (4) intended to retain the boot of the user and a plate pivoting around a transverse pivot axis (X, X') including a retaining assembly for the boot. A longitudinal position of the rear retaining assembly is adjustable for in order to conform the longitudinal dimension of binding, with the size of the boot, by displacement toward the front or towards the rear and locking it in the chosen position. The front retaining stirrup is mounted to a front horizontally extending plate (7), which is pivotally retained on the webbing around the pivot axis (X, X'), while the rear retaining part is mounted on a lower support wall (9), extended toward the front by a sliding member (10) intended to cooperate, with a slide channel of corresponding form defined under the front plate (7) of the front retaining assembly (4*a*).

7 Claims, 5 Drawing Sheets

MOUNTING FOR RETAINING A BOOT ON A SNOWSHOE

BACKGROUND

The present invention relates to a snowshoe and more particularly a longitudinal position adjusting device in its means for mounting the boot.

The snowshoes, devices known for very many years, have been used for several centuries by the Scandinavian populations to move on snow. Until recently, snowshoes were used by ordinary travelers or soldiers to allow the populations and the alpine troops to move on snow for their movements required by the everyday life. Currently, snowshoes are instead used by walkers or sportsmen who undertake excursions and walks, and even competitions. But the sportsmen, although participating for their pleasure, are increasingly demanding for the equipment which they use, and it is true that the currently sold products do not give whole satisfaction.

One knows many mounting devices intended to equip snowshoes, such as rubber slippers or bindings of the type including front and rear retaining means intended to retain the boot of the user on an articulated plate. According to these bindings the rear retaining means are slidably disposed at the rear of the plate to be able to be moved forwards and backwards longitudinally and to be positioned and locked in a determined longitudinal position, adapted to the length of the boot of the user. This type of device for example is described in French language patents FR 0,002,823, FR 2,606,660, FR 2,742,347, FR 2,760,375, EP 0 671 190.

However, such devices present disadvantages, because the adjustments are generally not very practical to use and often require a relatively long time to be implemented. Moreover, certain types of adjustment require the use of a key, a screwdriver or another tool. Besides if these types of devices are entirely correct, for boots of large sizes, they are entirely misfits for average and small sizes. Indeed, if the rear retaining means are moved forwards, the user notes that a large part of the pivoting plate extends beyond the back of his heel, which harms the esthetics of the product, as well as its comfort because with each step the user must raise this extending part, and which in addition catches snow.

SUMMARY

The present invention provides an improvement for the adjusting device making it possible to adapt the binding for the boot to the length of the latter.

Thus, According to its principal characteristic the snowshoe of the invention is of the type including a binding intended to retain the boot of the user, the aforementioned binding including a plate pivoting around a transverse pivot axis including the retaining means for the boot, namely the front means including a stirrup and a rear means including a rear retaining part, while the longitudinal position of the rear retaining means is adjustable in order to conform the longitudinal dimension of binding, to the size of the boot, i.e. to adapt the distance between the front stirrup and the rear retaining part to the sole of the boot, by displacement forwards or towards the back and locking in the chosen position, characterized in that the front clamp is joined to a front plate extending horizontally, which is pivotally retained on the webbing around the pivot axis, while the rear retaining part is mounted on a lower support wall, extended towards the front by a channel intended to cooperate, with a slide of corresponding form defined in the plate in front of the retaining means.

According to a complementary characteristic, the snowshoe includes a means for locking the position relative to the front retaining means once its position chosen, which according to the embodiment described by way of example includes the co-operation of a movable latch with a corresponding tooth.

Let us add that whatever the longitudinal position of the rear mountain means, no part of the pivoting plate extends rearward of the aforesaid rear retaining means, and that no part of the pivoting plate extends forward of the aforesaid front retaining means.

Also let us note that in the extreme front position the sliding member does not extend forward of the front retaining means.

BRIEF DESCRIPTION OF THE DRAWINGS

Other characteristics and advantages of the invention will emerge from the description which will follow compared to the annexed drawings which are given only by way of non-restrictive examples.

FIGS. 1 to 7*b* illustrate a snowshoe according to the invention.

FIG. 1 is a top view.

FIG. 2 is a side view.

FIG. 3 is a prospective view of the binding before the installation of the rear retaining means on the pivoting plate.

FIG. 4 is a prospective view of the binding, the rear retaining means being set in place on the pivoting plate.

FIG. 5*a* is a top view.

FIG. 5*b* is a side view.

FIG. 6*a* is a top view.

FIG. 6*b* is a side view.

FIGS. 7*a*, 7*b* are diagrammatic views in partial section showing the jamming lock respectively in its inactive raised not-locking position (FIG. 7*a*) and in its active locking position 7*b*.

DETAILED DESCRIPTION

Figure 1:
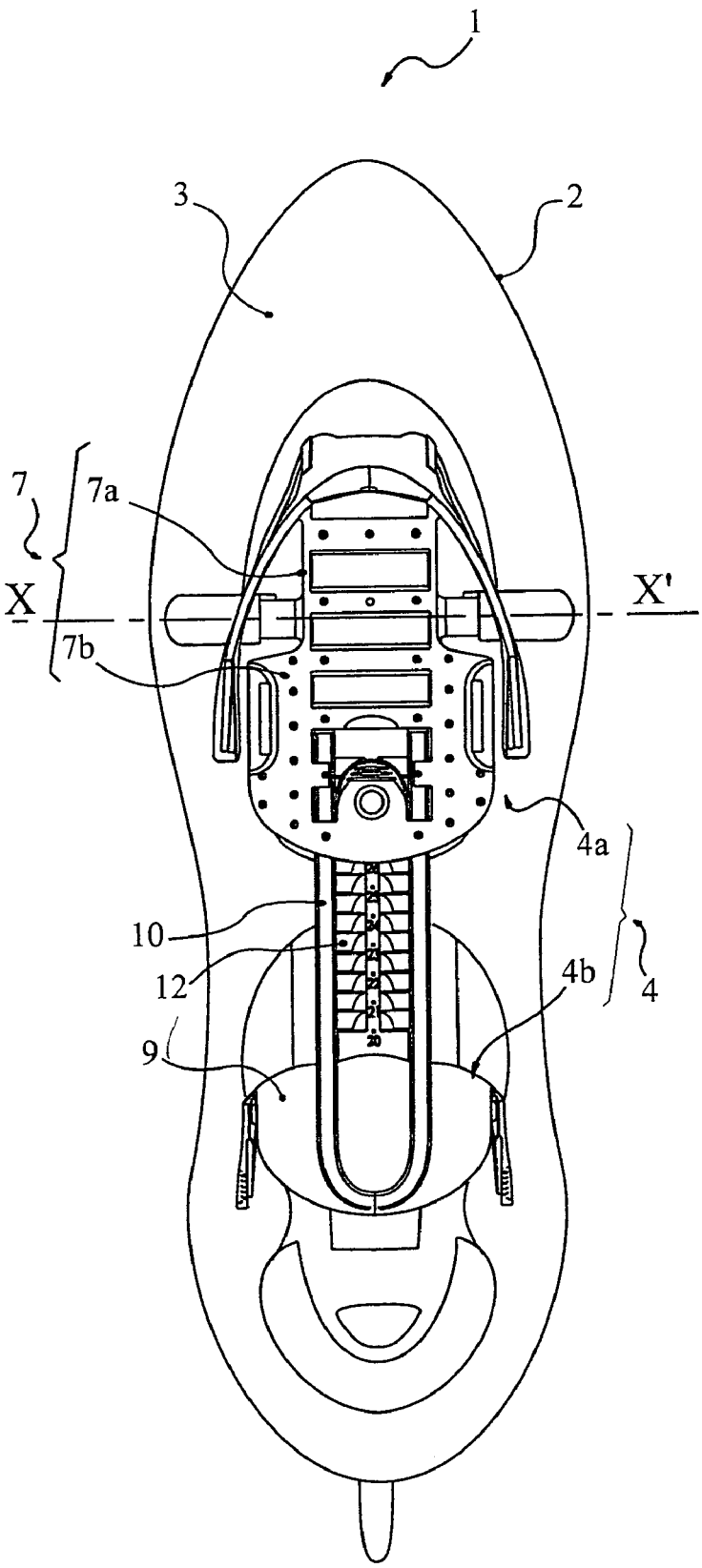
Figure 2:
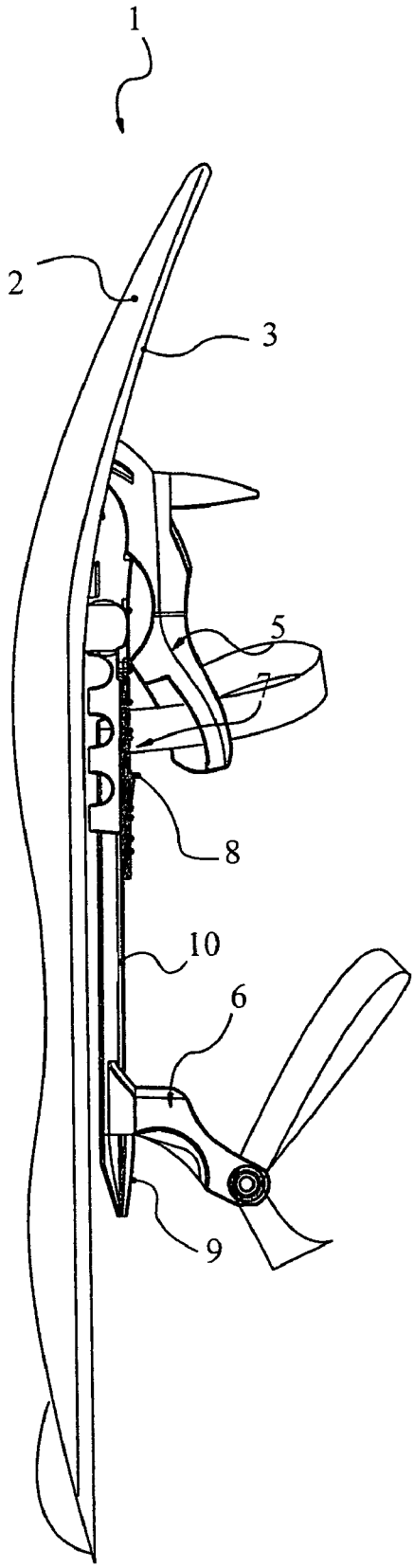
Figure 3:
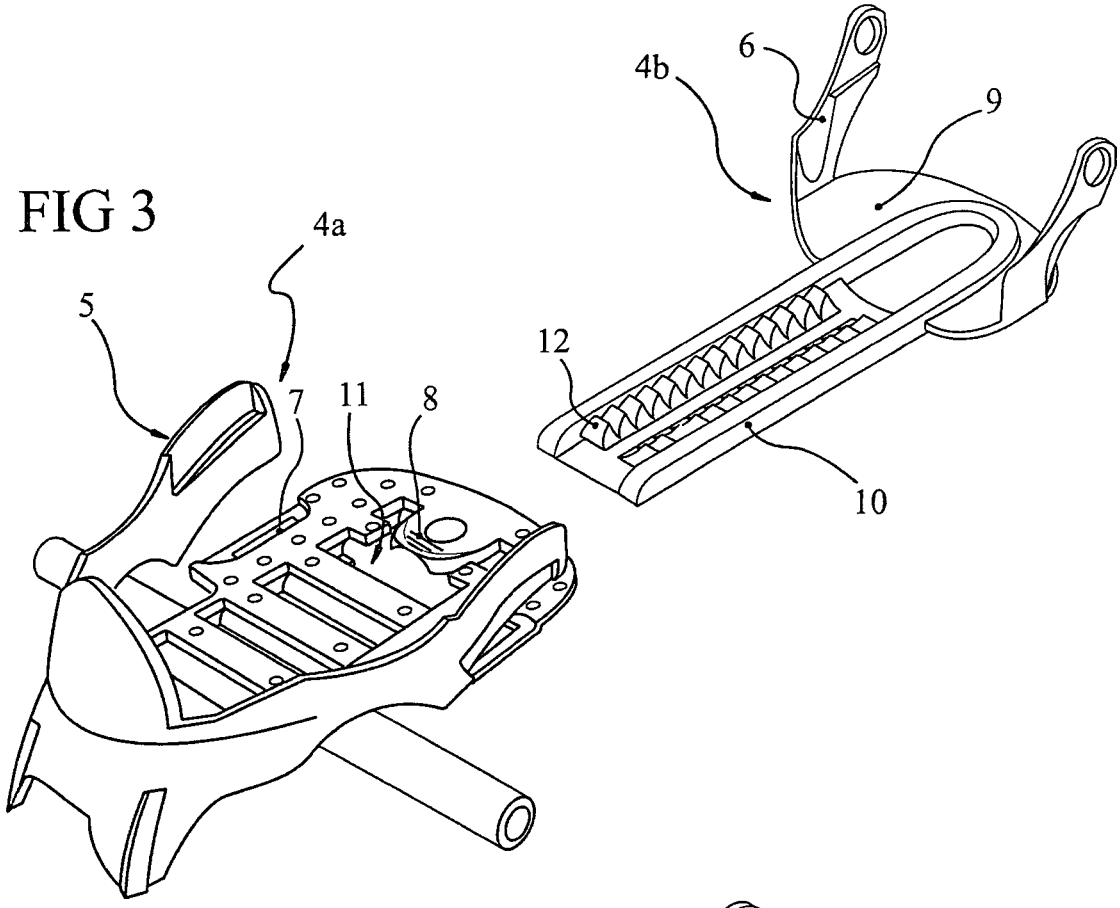
Figure 4:
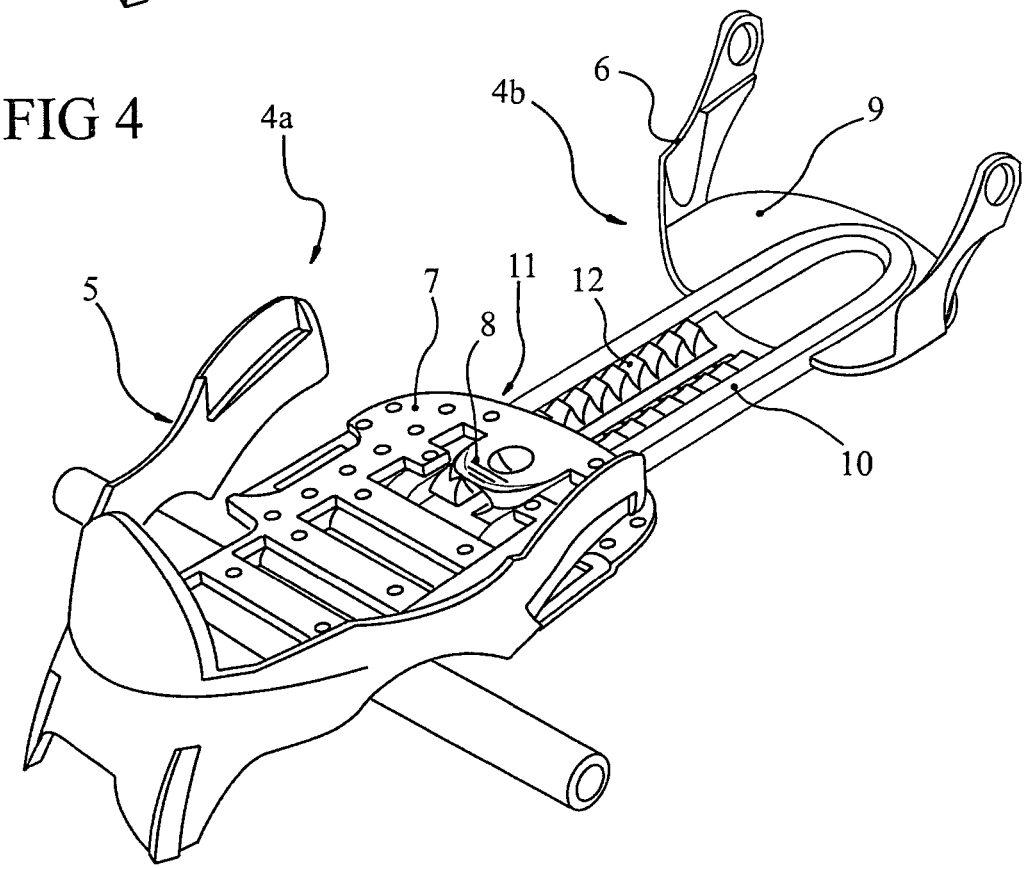
Figure 5A:
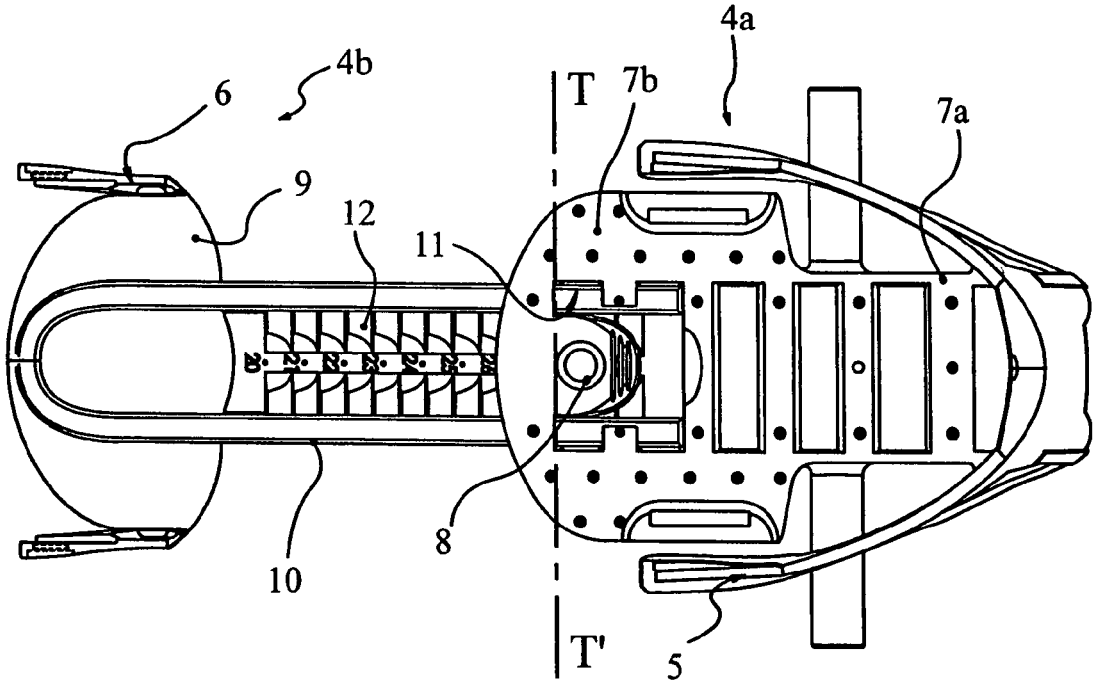
FIGS. 5*a*, 5*b* show the binding according to which the rear retaining means are in a position of maximum rear extension.
Figure 5B:
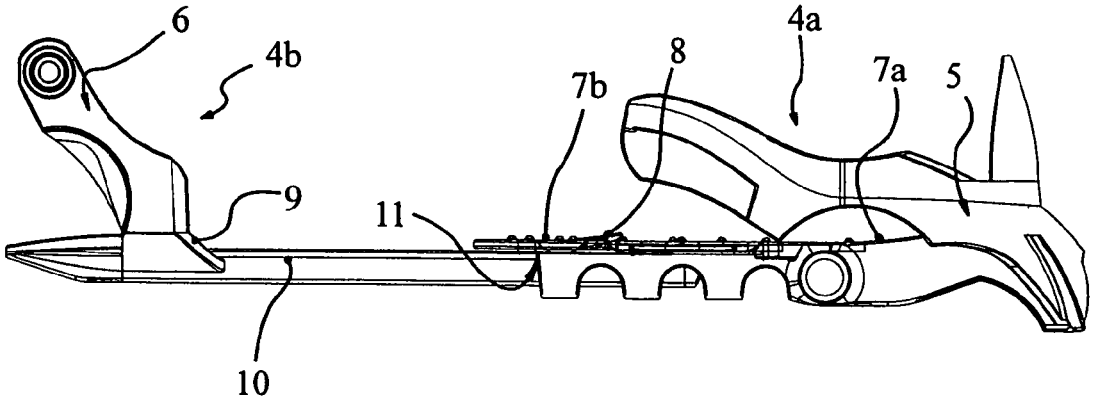

The snowshoe indicated under the general reference 1 is presents itself as an openwork plate on which the boot of the user is attached, and which is composed of a principal framework 2 and a webbing 3, including all of the walls supporting the binding 4 intended to retain the boot of the user.

The aforementioned webbing 3 with all of its internal walls forms in a known way, a general lower surface of support on snow making it possible for the user not to sink too far into the snow and this, thanks to the relatively significant bearing surface. The invention although described according to an embodiment whose webbing is of plastic material, it can of course find application on any other type of snowshoe such as for example with a peripheral framework made of an aluminum tube holding a fabric forming the webbing.

Let us note that binding 4 intended to retain the boot is, according to the illustration given by way of example, articulated compared to the webbing 3 of the snowshoe itself, according to a transverse axis X, X', in order to allow the user to raise his heel when moving forward.

The aforementioned binding carrying the general reference 4 is includes an articulated plate including the retaining means for the boot, namely of the front means 4*a* and the rear means 4*b*. These means are made of semi rigid elements and flexible straps such as is illustrated by way of example.

Thus, the front end of the boot is, in itself known way, retained by a front stirrup 5, likewise is its rear end, thanks to a rear retention part 6.

According a preferred embodiment, the front retaining means 5 are connected with but removable from of a front retaining plate 7 pivoting on the webbing around the pivot axis X, X'. The aforementioned front plate extends substantially horizontally, partly in front of the pivot axis X, X' by a front part 7*a* and partially to the rear of this axis, by a rear part 7*b*.

Let us specify that the front plate includes a movable latch 8 disposed advantageously on the rear part 7*b*, whose function will be explained later in the description.

The rear retaining means 4*b* include a rear retaining part 6 mounted on a lower support wall 9, and a flexible strap such as that is illustrated.

Let us note that according to the invention the longitudinal position of the rear retaining means 4*b* is adjustable in order to conform to the longitudinal dimension of binding, with the size of the boot, i.e. to adapt the distance between the front stirrup 5 and the rear retaining part 6, with the dimension of the sole of the boot, by displacement forwards or towards the rear and locking in the selected position.

Thus, the support lower wall 9 of the rear retaining means 4*b* is extended forwards by a sliding member 10 intended to cooperate, with a slide channel 11 of corresponding form defined in the front plate 7 of the front retaining means 4*a*.

The movable latch 8 is intended to lock the sliding member with the front plate 7, once in the selected longitudinal position.

To this end the upper surface of the sliding member 10 includes teeth 12 made up by a succession of transverse hollow contours.

The movable latch 8 is pivotally movable around a transverse axis T, T' to be able to assume two positions, namely an active lowered locking position and an inactive raised unlocking position. Let us note that the latch includes a locking tooth 13 intended to cooperate with one of the deep locking profiles when the latch is in its active locking position.

It is understood that the latch 8 with its co-operation with a tooth 12 constitute the means of locking of the rear retaining means 6 relative to the front retaining means 5 once its selected position is selected.

Let us add that the front retaining means 4*a*, comprising the front unit, formed by the front stirrup 5 and the front plate 7 with its latch 8, is a unit made advantageously out of plastic. Thus, the latch 8 advantageously injection molded with the other elements of the front unit, is made such that its upward pivoting is made against the natural resilience of the plastic, and thus returns automatically in the active lower locking position.

Let us note that the latch 8 disposed on the front plate 7 is in the zone occupied by the sole of the boot. Thus the sole of the boot, resting against the latch, prohibits any inopportune unlocking.

It was understood that thanks to the suggested construction, whatever the longitudinal position of the rear retaining means, no element of the pivoting plate extends past the rear of the aforesaid rear retaining means.

Figure 6A:
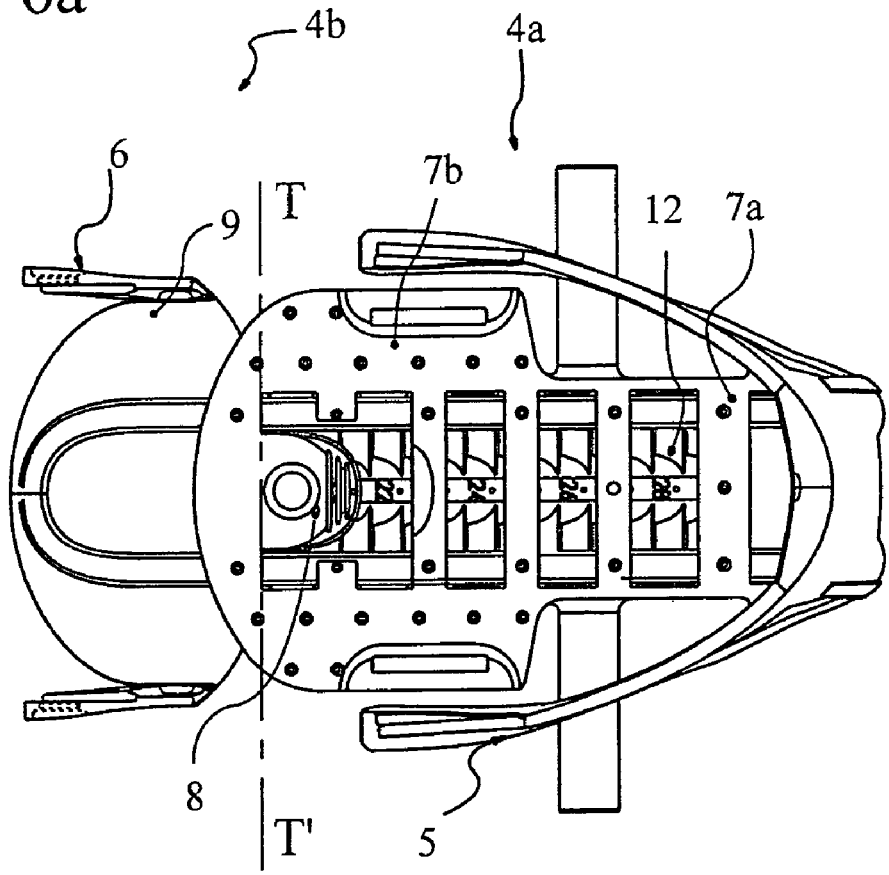
FIGS. 6*a*, 6*b* show the binding according to which the rear retaining means are in a maximum advanced position.
Figure 6B:
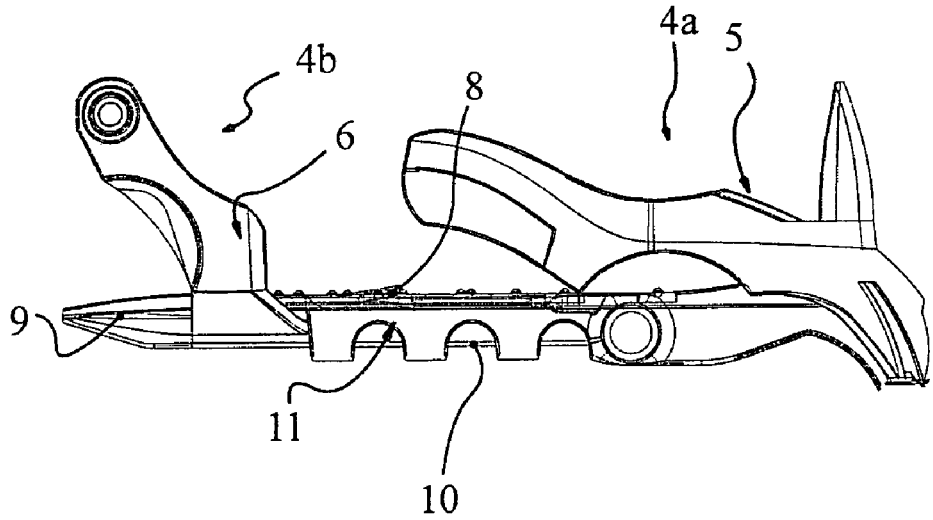
Figure 7A:
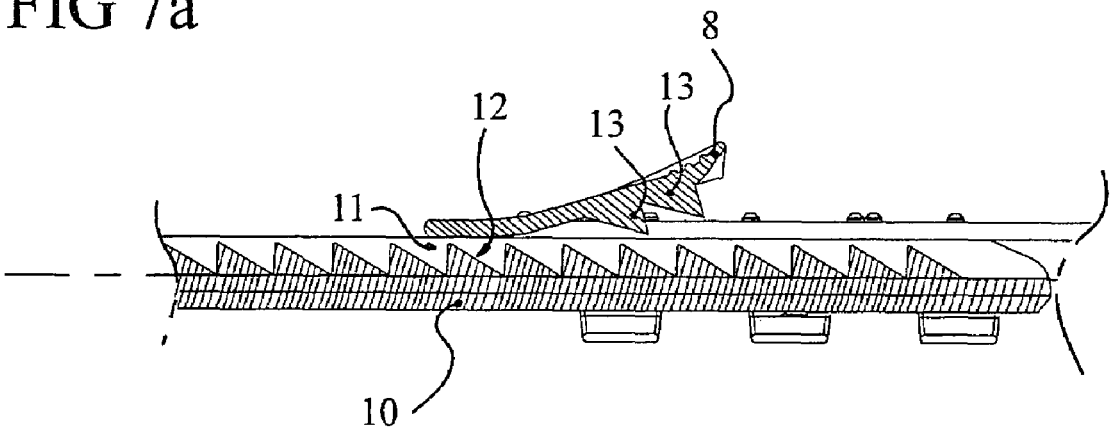
Figure 7B:
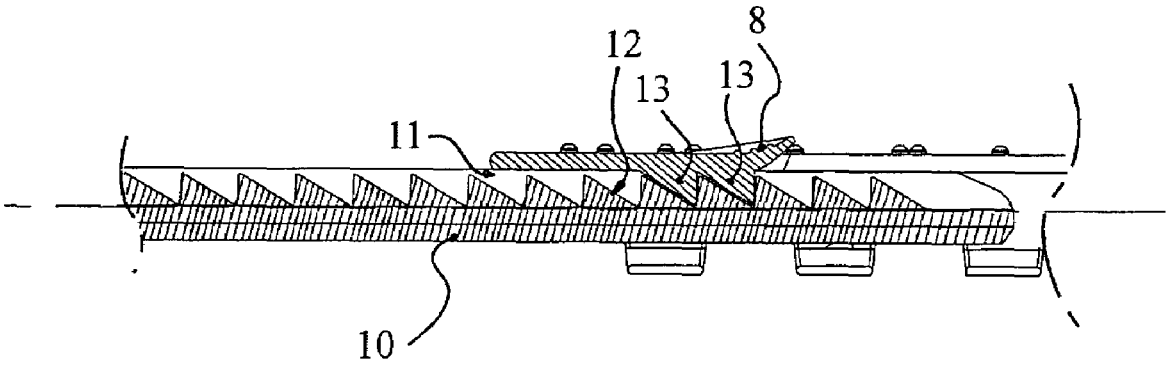

In the same way, thanks to the proposed construction whatever the longitudinal position of the rear retaining means, no element of the pivoting plate extends past the front of the front retaining means. Indeed in the extreme forward position as represented in FIGS. 6*a*, 6*b*, one notes that the sliding member 10 does not extend to the front.

It will be also noted that a system of stops is designed to limit displacement forwards and towards the rear of the rear retention means.

Of course, the invention is not limited to the embodiments described and represented by way of examples, but it includes also all the technical equivalents like their combinations.

The invention claimed is:

1. A snowshoe including a binding configured to retain a boot of a user, said binding comprising:

a plate pivoting around a transverse pivot axis and including retaining means for the boot, the retaining means including:

a retaining stirrup and a rear retaining part, a longitudinal position of the rear retaining part being adjustable in order to conform a longitudinal dimension of binding with the size of the boot by displacement forwards or towards the rear and locking in the chosen position, the front retaining stirrup being removably mounted to a horizontally extending front plate, which is pivotally retained on webbing around the pivot axis, the rear retaining part being mounted on a lower support wall, extended forwards by a sliding member configured to cooperate with a slide channel of corresponding form defined under the front plate, and wherein:

a locking element locks the position of the rear retaining part relative to the front retaining means once its position is selected, the locking element includes co-operation of a movable latch with a corresponding tooth, and the movable latch is disposed on the front plate and the tooth is disposed on the sliding member of the rear retaining part.

2. The snowshoe according to claim 1, wherein the latch is disposed in a zone occupied by a sole of the boot, such that the sole of the boot rests against the aforementioned latch, prohibiting inopportune unlocking.

3. The snowshoe according to claim 1, wherein in all longitudinal positions of the rear retaining part, no element of the pivoting plate extends rearward of said rear retaining part, and no element of the pivoting plate extends forward of the aforesaid retaining stirrup.

4. A snowshoe including a binding configured to retain a boot of a user, said binding comprising:

a plate pivoting around a transverse pivot axis and including retaining means for the boot, the retaining means including:

a retaining stirrup and a rear retaining part, a longitudinal position of the rear retaining part being adjustable in order to conform a longitudinal dimension of binding with the size of the boot by displacement forwards or towards the rear and locking in the chosen position, the front retaining stirrup being removably mounted to a horizontally extending front plate, which is pivotally retained on webbing around the pivot axis, the rear retaining part being mounted on a lower support wall, extended forwards by a sliding member configured to cooperate with a slide channel of corresponding form defined under the front plate, and wherein in all longitudinal positions of the rear retaining part, no element of the pivoting plate extends rearward of said rear retaining part, and no element of the pivoting plate extends forward of the aforesaid retaining stirrup, wherein in an extreme front position, the sliding member does not extend forward of the front retaining part.

5. The snowshoe binding configured to retain a boot of a user, comprising:

a front binding assembly including:

a plate pivotally supported to pivot around a pivot axis, a front retaining assembly supported on the front plate and configured to retain a toe of the boot, and a slide channel defined in conjunction with the plate;

a rear binding assembly including:

a rear retaining assembly configured to receive a heel of the boot, a forward extension extending forward from the rear retaining assembly and slidably received in the slide channel of the plate, such that a distance between the front retaining assembly and the rear retaining assembly is adjustable; and, a lock assembly configured to lock the forward extension relative to the plate to set a selected distance between the front and rear retaining assemblies, wherein the slide channel and the forward extension are configured such that the forward extension is prevented from extending forward of the plate.

6. The snowshoe binding according to claim 5, wherein the lock assembly includes:

a latch carried on the plate and having an upper surface that engages a sole of a received boot and a pawl extending from a lower surface;

a series of teeth defined in an upper face of the forward extension, the pawi being configured to engage the teeth when the latch is in a lower position and to permit free sliding of the forward extension when the latch is in a raised position, such that engagement of the sole of the received boot and the latch prevents the latch from moving to the raised position.

7. The snowshoe binding according to claim 5, wherein the front plate is configured such that the rearward extension of the front plate rearward of the rear binding assembly is prohibited.

* * * * *